US005188543A

United States Patent [19]

Swift

[11] Patent Number: 5,188,543

[45] Date of Patent: Feb. 23, 1993

[54] ELECTRICAL CONNECTOR INCLUDING A REMOVABLE CIRCUIT COMPONENT

[75] Inventor: Peter R. Swift, Toronto, Canada

[73] Assignee: Amphenol Corporation, Wallingford, Conn.

[21] Appl. No.: 745,176

[22] Filed: Aug. 15, 1991

[51] Int. Cl.[5] ..... H01R 13/66

[52] U.S. Cl. ..... 439/620

[58] Field of Search ..... 439/620, 608, 609; 333/182, 183

[56] References Cited

U.S. PATENT DOCUMENTS

| | | | |
|---|---|---|---|
| 3,200,355 | 8/1965 | Dahlen | 333/79 |
| 3,854,107 | 12/1974 | Tuchto et al. | 333/79 |
| 3,870,978 | 3/1975 | Dreyer | 439/620 X |
| 3,951,514 | 4/1976 | Medina, Jr. | 350/96 C |
| 4,572,600 | 2/1986 | Nieman | 339/14 R |
| 4,582,385 | 4/1986 | Couper et al. | 339/147 R |
| 4,600,262 | 7/1986 | Nieman et al. | 339/147 R |
| 4,741,710 | 5/1988 | Hogan et al. | 439/620 |
| 4,746,310 | 5/1988 | Morse et al. | 439/620 |
| 4,747,789 | 5/1988 | Gliha | 439/620 |
| 4,846,732 | 7/1989 | Meelhuysen | 439/620 |

*Primary Examiner*—Eugene F. Desmond
*Attorney, Agent, or Firm*—Bacon & Thomas

[57] ABSTRACT

A contact assembly for an electrical connector includes a rear contact and a transient suppression or filter component mounted on the rear contact in axial alignment therewith. A ground connection between the component and the shell of the connector is established by a ground contact extending from a ground plate. The grond contact engages the component as the contact is pushed into the connector. A retention member in the connector is arranged to the rear contact in the connector. A front contact is mounted on the other side of the ground plate from the rear contact and includes a resilient member extending from front contact to engage the rear contact when the rear contact is inserted into the connector, thereby establishing an electrical connection between the front and rear contacts.

21 Claims, 7 Drawing Sheets

ELECTRICAL CONNECTOR INCLUDING A REMOVABLE CIRCUIT COMPONENT

BACKGROUND OF THE INVENTION

1. Field of the Invention

This invention relates to electrical connectors, and in particular to an electrical connector having transient suppression or filtering capabilities.

2. Description of Related Art

As circuit densities of electronic devices increase, sensitivity of the individual circuit elements in the devices to transient voltages also increases, making ever more critical the need for electrical filtering and transient voltage suppression at all signal and data inputs. This is often most conveniently accomplished by placing transient suppression and/or filtering components within the miniature high or medium density electrical connectors used to connect signal and data lines with the electrical devices.

Because of the criticality of filtering or transient suppression in signal and data processing equipment, each component used in a filter or transient suppression connector must be individually tested both before and after assembly into the connector. If even one component is found to be defective, it must be replaced. Consequently, it is important that the components be individually removable for repair or replacement after assembly into the connector, subsequent to testing. If the components are not individually removable, then the entire component/contact subassembly must be replaced upon finding that a single component is defective.

In order to permit removal of the transient suppression or filtering component from the connector for repair or replacement, while meeting size requirements, it has been proposed to place the component directly on the contact. For example, it has been proposed, in the specific case of chip diodes, to notch the contact in order to permit the diode to be carried by the contact while minimizing the space occupied by the combined diode and contact assembly. However, manufacture of such contact/component assemblies is greatly complicated by the need to machine the contact and secure a component in the notch, and by difficulties in achieving a secure connection to ground after placement of the contact in the connector.

SUMMARY OF THE INVENTION

In view of the above-described disadvantages of conventional filter and transient suppression connectors, it is an objective of the invention to provide an improved filter or transient suppression connector having a simplified grounding arrangement, and which is easily assembled without the need for complex contact machining operations.

It is a further objective of the invention to provide an improved transient suppression or filter connector having an electrical contact which carries a filter or transient suppression component, and which is individually removable together with its component from the connector.

It is a still further objective of the invention to provide an improved electrical contact which carries a filter or transient suppression component, and which is removable together with the component from the connector in which it is installed.

It is yet another objective of the invention to provide an improved removable electrical contact which carries a filter or transient suppression component, grounding of which may be achieved in an especially simple manner.

These objectives are accomplished by providing a socket or a pin contact having a filter or transient suppression component secured to the contact in axial alignment therewith. When the contact is inserted into the connector, it locks in place with a retention clip which is held captive between two dielectric inserts in the connector. A ground electrode on the component contacts and is thereby electrically connected to a grounding contact which extends from a ground plate in the connector. The electrical path to ground is completed by connection of the grounding plate to the shell of the connector, which is then grounded to the system.

Because the component is axially mounted, the ground contact engages the ground electrode of the component along parallel planar surfaces, maximizing the contact area and providing a more stable ground connection than in prior devices where the ground electrode contact surface is perpendicular to the ground plate. Also, because the component need not be fitted within a notch, larger components can be used.

To facilitate removal of the contact, a conventional hollow cylinder contact removal tool may be inserted over the socket end of the contact diode assembly, causing tines on the retention clip to be deflected away from a retention shoulder on the contact body. The contact/transient suppression or filter component assembly may then be withdrawn from the connector for repair or replacement.

BRIEF DESCRIPTION OF THE DRAWINGS

FIG. 6(*b*) illustrates the manner in which the contact of FIG. 5 is removed from the connector.

FIG. 7(*b*) is a perspective view of the embodiment of FIG. 5.

DETAILED DESCRIPTION OF THE PREFERRED EMBODIMENTS

Figure 1:
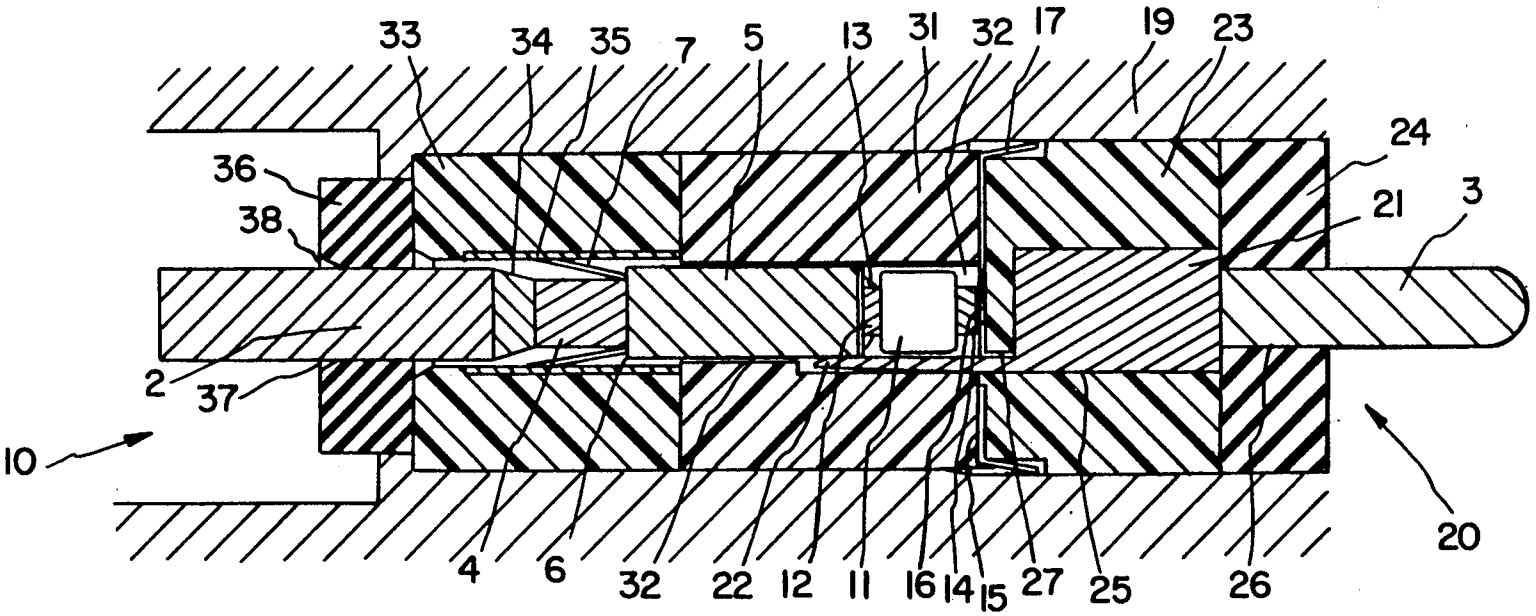
FIG. 1 is a cross sectional side view of a transient suppression or filter contact assembly in accordance with a first preferred embodiment of the invention.
Figure 2:
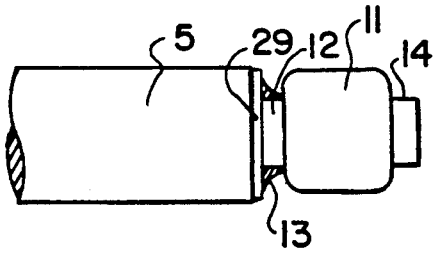
FIGS. 2–4 are side views, partially in cross section, showing variations of the termination end of the transient suppression or filter contact of FIG. 1.
Figure 6A:
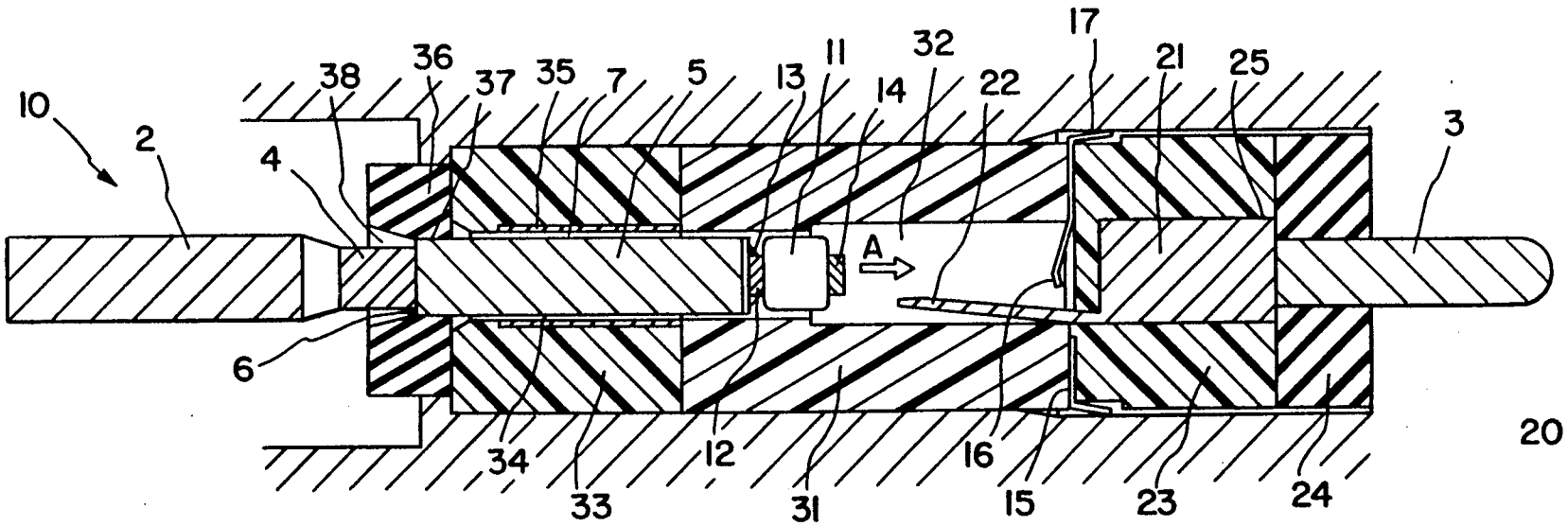
FIG. 6(*a*) illustrates the manner in which the contact of FIG. 1 is removed from the connector.
Figure 6B:
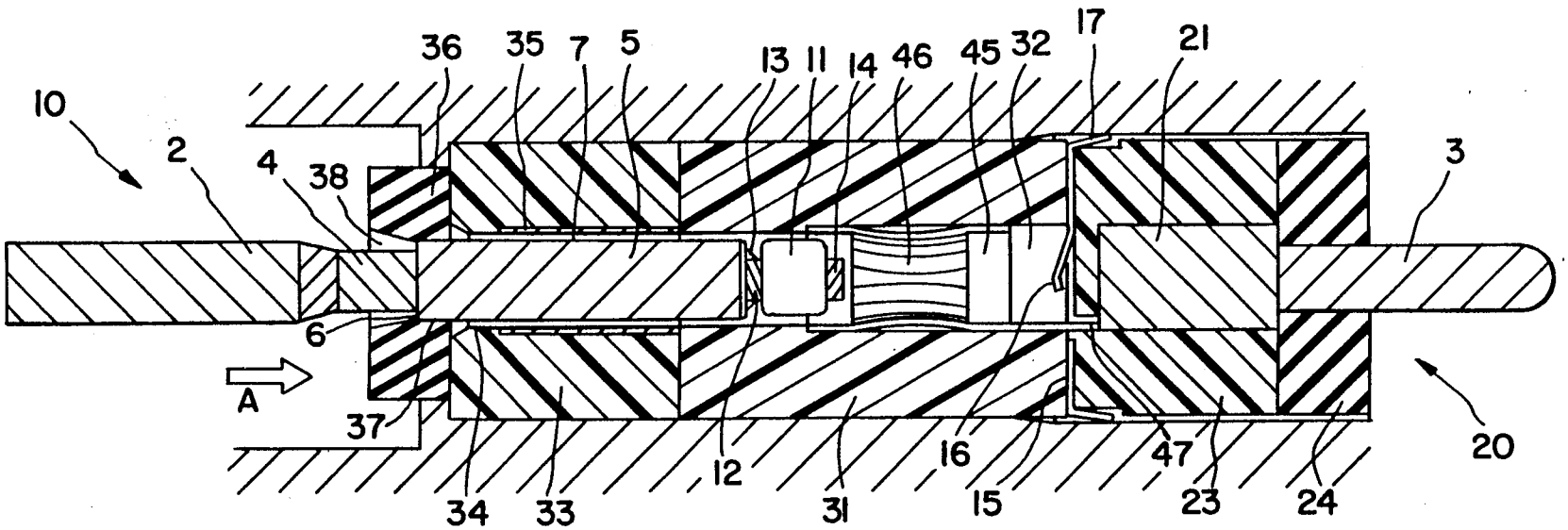

As shown in FIGS. 1, 2, 6(*a*), and 7(*a*), a filter or transient suppression contact arrangement according to a first embodiment of the invention includes a contact assembly provided with mating sections 2 and 3 at respective ends of the assembly for mating the contact assembly with a corresponding contact or conductor on a second connector, a cable, or another electrical device. Mating sections 2 and 3 may take the form of a socket or pin, as is well known, or any other form as required by the application in which the connector will be used. As illustrated, mating section 2 is a socket and mating section 3 is a pin.

The contact assembly of the preferred embodiment is formed from two contacts. A removable rear contact 10 includes mating section 2, an intermediate section 4, and a termination section 5. In accordance with this preferred embodiment, intermediate section 4 has a smaller diameter than termination section 5 in order to form a shoulder 6 which engages a retention tine in the connector to prevent removal of the rear contact 10 during normal use. Removal is accomplished by disengaging tines 7 from shoulder 6 using a conventional cylindrical contact removal tool, permitting withdrawal of rear contact 10 from the connector together with a filter or transient suppression component 11.

Filter or transient suppression component 11 is directly connected to an end face 29 of termination section 5. In the preferred embodiment shown in FIG. 1 and also in FIGS. 2 and 3, live electrode 12 of component 11 is secured by a solder connection 13 to an end face of termination section 5 such that component 11 is in axial alignment with rear contact 10.

Although component 11 is shown as a cylindrical diode or capacitor, it will be appreciated that a variety of different component configurations and types of component could be used. For transient suppression purposes, a diode is preferred, although other voltage clamping devices such as varistors may be substituted, while for filtering purposes, the component will generally take the form of a capacitor or capacitive filter device.

Figure 8:
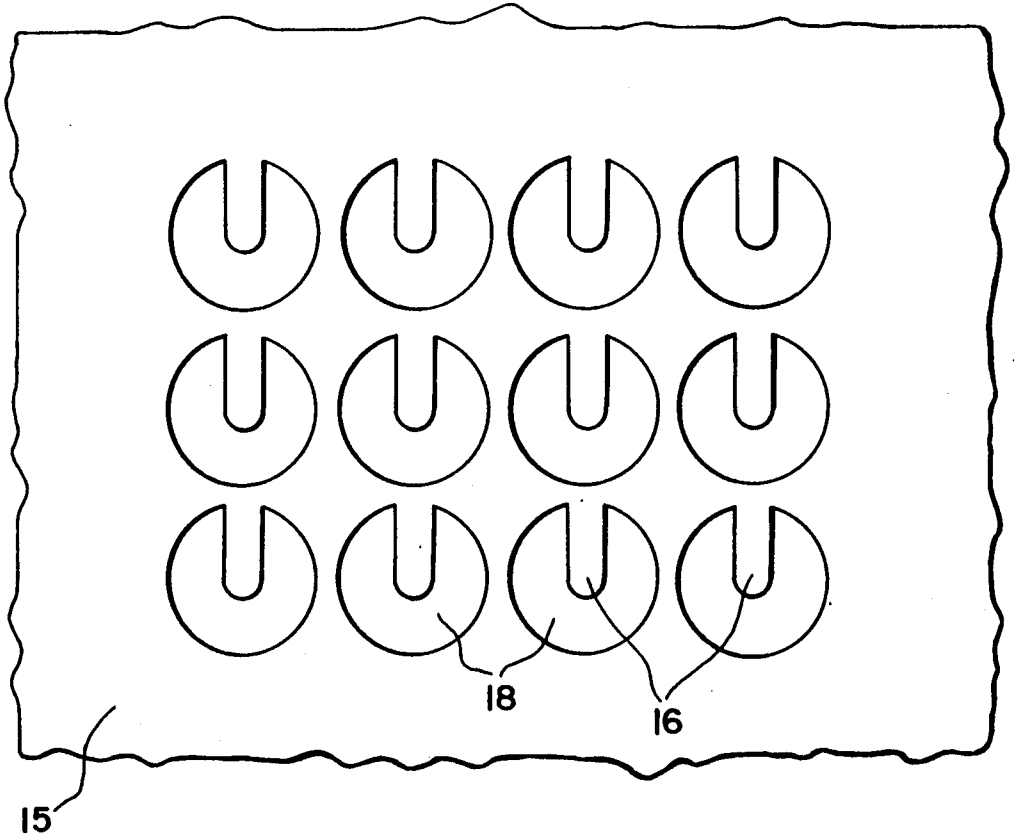
FIG. 8 is an elevated plan view of a grounding plate design for a multiple contact array according to a preferred embodiment of the invention.

Component 11 also includes a ground electrode 14 which directly contacts a ground plate 15 provided in the connector. Ground plate 15 includes a resilient ground contact 16 biased to ensure a good electrical contact with ground electrode 14, and ground spring tines 17 for establishing electrical contact between the ground plate 15 and the shell 19 of the connector. As shown in FIG. 8, this ground plate design may be extended for use with a multiple contact array, in which case ground plate 15 can be formed from a single stamped plate having a plurality of apertures 18 into which extend the integral ground contacts 16.

To ensure a good electrical connection when the rear contact is inserted into the connector, ground contact 16 is preferably biased to project out of the plane of ground plate 15, and into the path of insertion of contact 10. As a result, a restoring force in the direction of ground electrode 14 is created when the ground contact is engaged thereby and pushed forward by the force of insertion.

According to the first preferred embodiment of the invention, fixed front contact 20 includes mating end 3 and an intermediate section 21 from which extends a resilient feedthrough member 22 for establishing electrical contact between rear contact 10 and front contact 20. This section is fixed in the connector by a first dielectric member 23 and a gasket 24 having suitable bores 25 and 26 for retaining the front contact therein, and a passage 27 through which spring member 22 extends to engage the rear contact 10. Ground plate 15 is secured in the connector between dielectric member 23 and a second dielectric member 31 which includes a bore 32 shaped to accommodate termination section 5 of rear contact 10, the component 11, and spring member 22.

It will be appreciated that, for most purposes, front contact 20 will be permanently affixed to the connector. However, front contact 20 may optionally also be made separately removable through the front of connector for separate repair or replacement.

As shown in FIG. 1, a third dielectric member 33 includes a bore 34 in which is fitted a retention member 35. Retention tine 7 extends from member 35 for releasably retaining the rear contact 10 in the connector, as described above. Finally, a rubber gasket 36 or similar seal having a bore 37 may be provided to retain mating section 2 within the connector and to provide, together with gasket 24, an environmental seal for the component.

Figure 3:
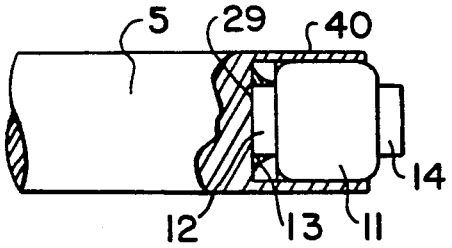
Figure 4:
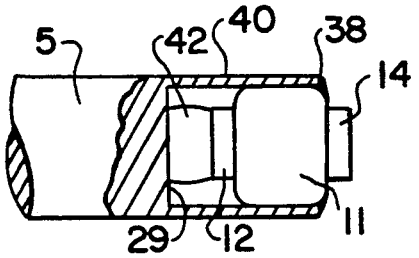

Referring to FIGS. 3 and 4, the termination end of rear contact 10 may take a variety of alternate forms, including the enclosed design shown in FIG. 3 in which a cylindrical extension 40 of the contact is provided to more securely attach the component to the contact, and to provide an additional surface for engagement with resilient feedthrough member 22 to establish an electrical connection between rear contact 10 and front contact 20. Further, as shown in FIG. 4, the manner in which live electrode 12 is electrically connected to termination section 5 may be varied by, for example, providing a conductive rubber connection member 42 between live electrode 12 and the termination section 5. Preferably, component 11 is retained within cylinder 40 by inwardly forming the cylinder end to obtain a lip 38. Numerous other variations in the manner in which the component is electrically connected to and retained within termination section 5 will undoubtedly occur to those skilled in the art, and it is therefore intended that all such variations be included within the scope of the invention.

Figure 5:
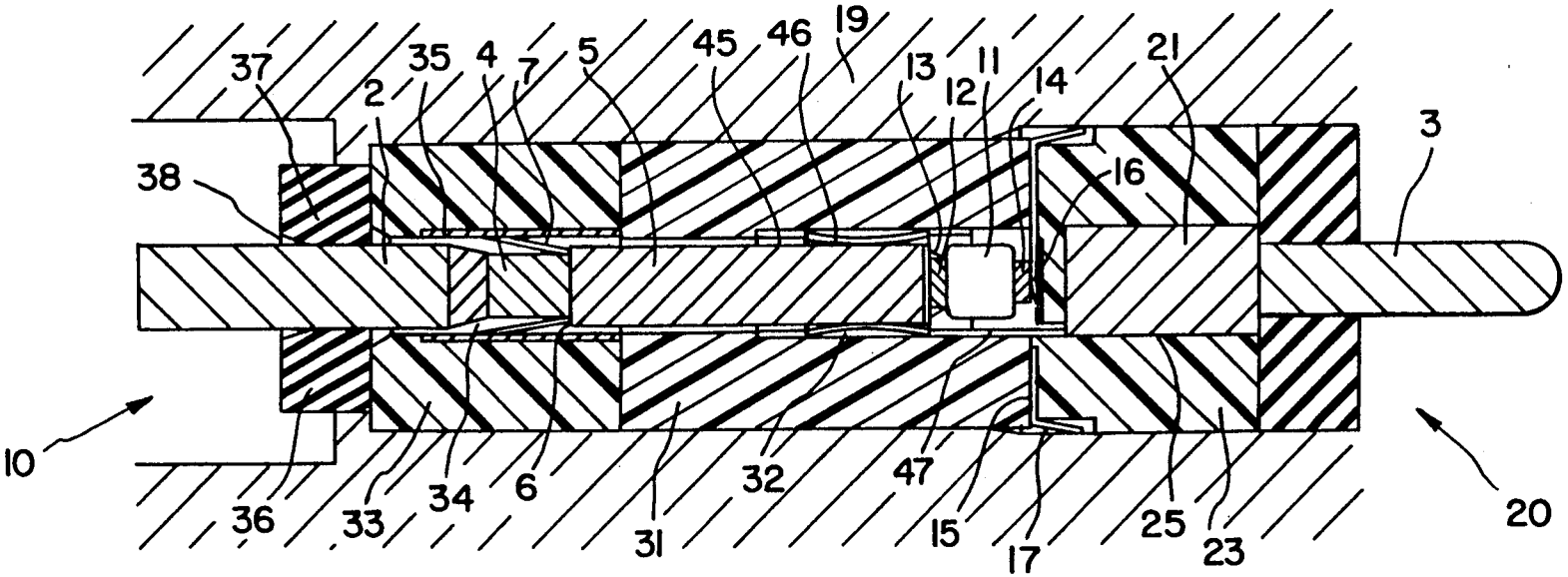
FIG. 5 is a view similar to that of FIG. 1 showing an alternate preferred embodiment of the invention.

In an alternative embodiment of the invention shown in FIGS. 5, 6(*b*), and 7(*b*), the requisite feedthrough electrical connection between front contact 20 and rear contact 10 takes the form of a resilient sleeve 45 including radially inward extending connecting members 46 which engage termination section 5 to establish electrical contact therewith when rear contact 10 is inserted into the connector. This design is more complex than that required for the above-described feedthrough member 22 of the first embodiment, but provides a more secure electrical connection. A connecting member 47 extends from front contact 20 to sleeve 45 through passage 27 in dielectric member 23. The remaining elements of the connector shown in FIG. 5 are identical to those shown in FIG. 1, except that the shape of bore 32 may be altered to accommodate sleeve 45. It will be appreciated that numerous other variations are also possible on the manner in which front contact 20 is electrically connected in a removable manner with rear contact 10.

Figure 7A:
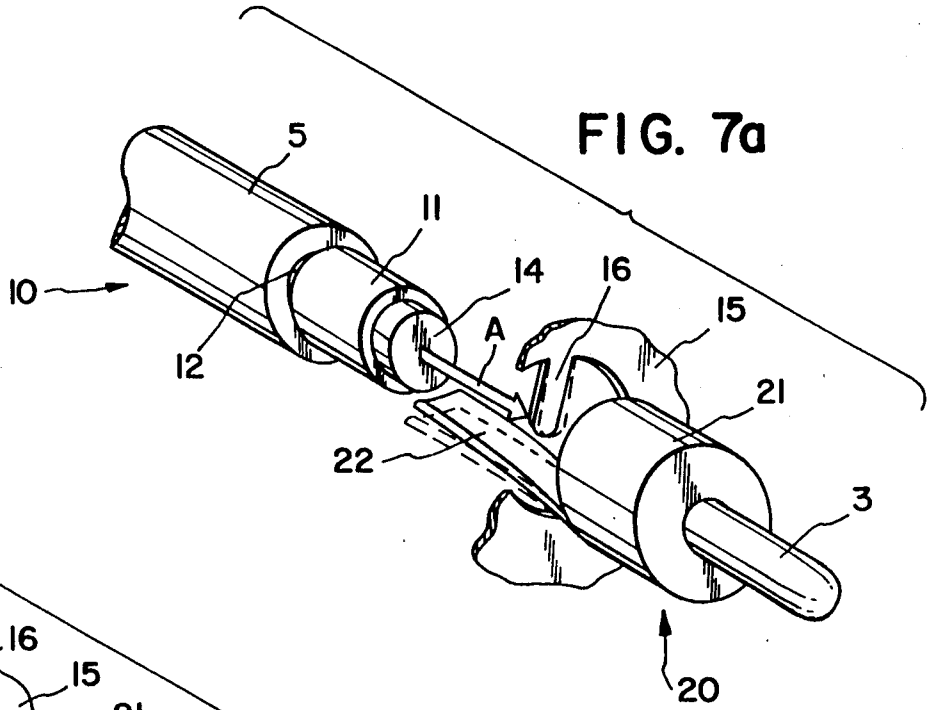
FIG. 7(*a*) is a perspective view of the embodiment of FIG. 1.
Figure 7B:
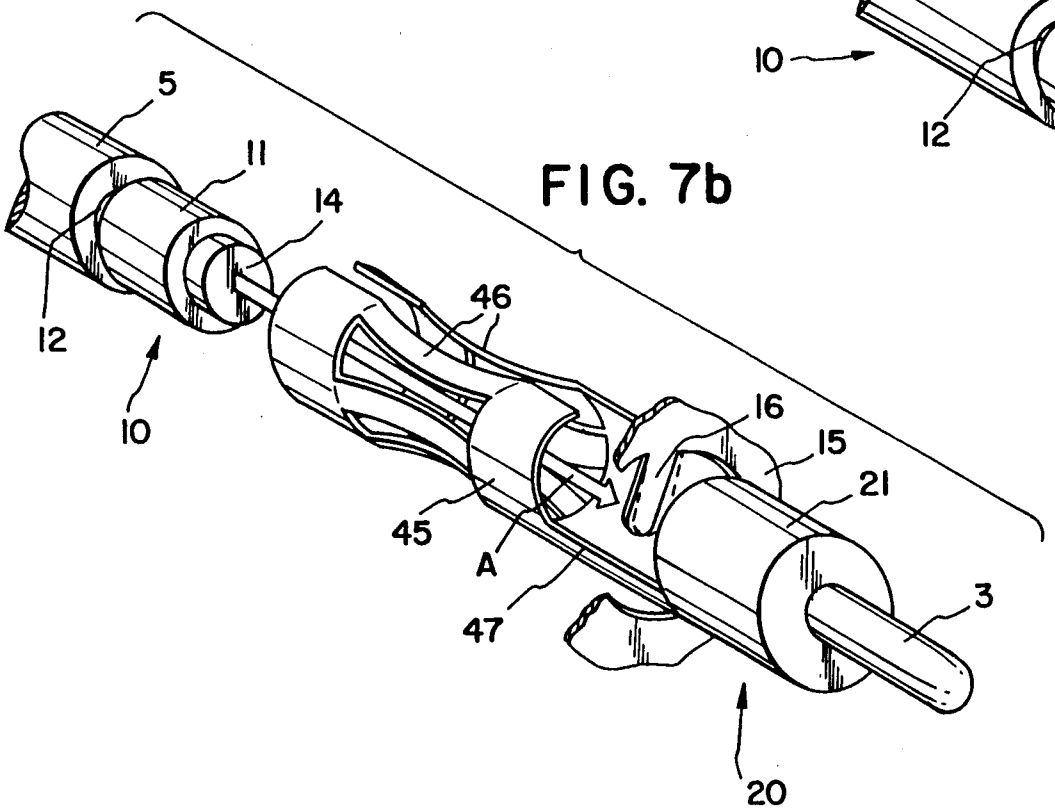

The method by which rear contact 10 is inserted into the connector for both embodiments of the invention is shown in FIGS. 6 and 7. In both cases, assembly is accomplished by simply inserting the contact 10 into the connector in the direction of arrow A through flared opening 38 of bore 37, and through bores 34 and 32 until ground electrode 14 engages ground plate 15, and retention tines 7 have passed termination section 5. At this time, a restoring force of tines 7 causes them to flex inwardly and engage shoulder 6 to retain the contact in the connector.

In order to remove the contact, a cylindrical tool (not shown) is inserted through bore 37, which is part of a resilient member 36, and into bore 34, which has sufficient clearance to permit insertion of the removal tool. The removal tool engages resilient tines 7 to cause them to flex outwardly in order to permit termination section 5 to clear tines 7. Such contact removal tools are well-known in the art.

Having thus described specific embodiments of an improved filter or transient suppression contact arrangement for an electrical connector, it will of course be appreciated that the invention should not be limited to the above-described embodiments. Rather, it is anticipated that numerous variations will occur to those skilled in the art, and therefore it is intended that the invention be limited solely by the appended claims.

I claim:

1. An electrical connector, comprising:

a rear contact having a principal longitudinal axis including, at a rear end, means for mating said rear contact with a corresponding electrical conductor in a first electrical device and, at a front end, a termination section on which is mounted an electrical component having a ground electrode and a live electrode arranged in axial alignment with the rear contact, said live electrode being electrically connected to said rear contact;

means for removably retaining said rear contact within said electrical connector;

a front contact including, at a front end, means for mating said front contact with a corresponding electrical conductor in a second electrical device, and a feedthrough member extending rearwardly from the front contact for establishing an electrical connection between the front contact and the rear contact; and grounding means for electrically connecting said electrical component to a shell of said connector, wherein said grounding means includes an electrode contact surface which contacts a ground contact surface of said ground electrode, said contact surfaces being substantially perpendicular to said principal longitudinal axis.

2. A connector as claimed in claim 1, wherein said front contact is fixedly secured in said connector.

3. A connector as claimed in claim 1, wherein said feedthrough member is a resilient member extending from said front contact to engage said termination section of said rear contact when said rear contact is inserted into said connector.

4. A connector as claimed in claim 3, wherein said resilient member comprises a sleeve which fits around said termination section of said rear contact and includes inwardly extending contact spring contacts for engaging said termination section to provide a secure 360° electrical connection between said front contact and said rear contact.

5. A connector as claimed in claim 1, wherein said grounding means comprises a ground plate, means defining an aperture in said ground plate, and a ground contact in said aperture which includes said ground contact surface for engaging said electrode contact surface of said electrical component.

6. A connector as claimed in claim 1, wherein said ground contact extends rearwardly from said ground plate and engages said component in an axial direction.

7. An electrical connector as claimed in claim 1, wherein a live electrode of said electrical component is soldered to a front end face of said termination section.

8. A connector as claimed in claim 1, wherein said component is retained within a cylindrical opening in said termination section.

9. A connector as claimed in claim 1, wherein an electrical connection between a live electrode of said component and said termination section is established by means of a conductive rubber member placed between the component and an end face of the termination section, and wherein said termination section is formed to retain said component within said opening.

10. A connector as claimed in claim 1, wherein said means for retaining said rear contact in said connector comprises a cylindrical member having resilient tines extending therefrom, and a shoulder formed on said rear contact which engages said resilient tines when said rear contact is pushed into said connector.

11. A connector as claimed in claim 1, wherein said component is a diode.

12. A connector as claimed in claim 1, wherein said component is a capacitor.

13. An electrical contact, comprising:

an elongated conductive member, a portion of said elongated conductive member having a longitudinal axis and first and second ends at opposite ends of said axis;

means on said first end for mating said contact with a corresponding conductor in an electrical device;

a planar surface on said second end which extends transversely to said axis;

an electrical component comprising a first electrode which contacts said planar surface and a second electrode situated on an axially opposite side of said component from said first electrode, wherein an axis of said component between said first and second electrodes is colinear with said longitudinal axis, wherein said elongated conductive member includes a hollow cylindrical termination section extending longitudinally from said planar surface, said component being housed within said termination section.

14. A contact as claimed in claim 13, wherein said first electrode is soldered to said planar surface.

15. An electrical contact, comprising:

an elongated conductive member, a portion of said elongated conductive member having a longitudinal axis and first and second ends at opposite ends of said axis;

means on said first end for mating said contact with a corresponding conductor in an electrical device;

a planar surface on said second end which extends transversely to said axis;

an electrical component comprising a first electrode and a second electrode, said second electrode being situated on an axially opposite side of said component from said first electrode, wherein a axis of said component between said first and second electrodes is colinear with said longitudinal axis, wherein said elongated conductive member includes a hollow cylindrical termination section extending longitudinally from said planar surface, said component being housed within said termination section, wherein said component is electrically connected to said planar surface by a conductive resilient member placed between the component and the surface, and wherein said component is retained within said termination section by an inwardly formed lip on said termination section.

16. A contact assembly for an electrical connector, comprising:

a rear contact which includes an elongated conductive member, at least a portion of said elongated conductive member having a longitudinal axis and first and second ends at opposite ends of said axis, said elongated conductive member further including a termination section, means on said first end for mating said contact with a corresponding conductor in an electrical device, and a planar surface on said second end extending transversely to said axis;

an electrical component comprising a first electrode which contacts said planar surface and a second electrode situated on an axially opposite side of said component from said first electrode, wherein an axis of said component between said first and second electrodes is colinear with said longitudinal axis; and a front contact including, at a front end, means for mating said front contact with a corresponding electrical conductor in a second electrical device, and a feedthrough member extending rearwardly from the front contact for establishing an electrical connection between the front contact and the termination section of the rear contact.

17. An assembly as claimed in claim 16 wherein said feedthrough member is a resilient member extending from said front contact to engage said termination section of said rear contact when said rear contact is inserted into said connector.

18. An assembly as claimed in claim 14, wherein said resilient member comprises a sleeve which fits around said termination section of said rear contact and includes inwardly extending contact spring contacts for engaging said termination section to provide a secure 360° electrical connection between said front contact and said rear contact.

19. An assembly as claimed in claim 16, wherein said first electrode is soldered to said planar surface.

20. An assembly as claimed in claim 16, wherein said termination section is a hollow cylindrical termination section extending longitudinally from said planar surface, said component being housed within said termination section.

21. An assembly as claimed in claim 16, wherein said component is electrically connected to said planar surface by a conductive resilient member placed between the component and the surface, and wherein said component is retained within said termination section by an inwardly formed lip on said section.

* * * * *